US011223145B2

(12) United States Patent
Wendt et al.

(10) Patent No.: US 11,223,145 B2
(45) Date of Patent: Jan. 11, 2022

(54) CONTACT INSERT FOR A CONDUCTOR TERMINAL AND CONDUCTOR TERMINAL

(71) Applicant: WAGO Verwaltungsgesellschaft mbH, Minden (DE)

(72) Inventors: Stephan Wendt, Bad Eilsen (DE); Hans-Josef Koellmann, Minden (DE); Viktor Mickmann, Wunstorf (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 17/004,928

(22) Filed: Aug. 27, 2020

(65) Prior Publication Data

US 2021/0066824 A1 Mar. 4, 2021

(30) Foreign Application Priority Data

Aug. 27, 2019 (DE) ..... 20 2019 104 688.0

(51) Int. Cl.
*H01R 4/48* (2006.01)
*H01R 25/14* (2006.01)
*H01R 31/08* (2006.01)

(52) U.S. Cl.
CPC ..... *H01R 4/4818* (2013.01); *H01R 25/14* (2013.01); *H01R 31/085* (2013.01)

(58) Field of Classification Search
None
See application file for complete search history.

(56) References Cited

U.S. PATENT DOCUMENTS

| | | | | |
|---|---|---|---|---|
| 7,568,939 | B2 | 8/2009 | Diekmann | |
| 8,491,327 | B2 | 7/2013 | Hartmann | |
| 8,512,068 | B2 | 8/2013 | Gassauer | |
| 2019/0013598 | A1* | 1/2019 | Wu | H01R 13/502 |

FOREIGN PATENT DOCUMENTS

| | | |
|---|---|---|
| DE | 20 2006 003 400 U1 | 8/2007 |
| DE | 10 2008 055 776 B4 | 4/2011 |
| DE | 10 2010 051 899 A1 | 5/2012 |
| DE | 10 2010 012 820 B4 | 8/2012 |
| DE | 20 2016 101 052 U1 | 7/2017 |

* cited by examiner

*Primary Examiner* — Ross N Gushi
(74) *Attorney, Agent, or Firm* — Muncy, Geissler, Olds & Lowe, P.C.

(57) ABSTRACT

A contact insert of a conductor terminal for connecting at least one electrical conductor, wherein the contact insert comprises at least one bus bar and at least one clamping spring, wherein the bus bar has at least one through opening, wherein the contact insert has a perforated collar which is designed as a component separate from the bus bar, wherein the perforated collar circumferentially surrounds the through opening at least partially or completely on at least one side of the bus bar.

15 Claims, 4 Drawing Sheets

CONTACT INSERT FOR A CONDUCTOR TERMINAL AND CONDUCTOR TERMINAL

This nonprovisional application claims priority under 35 U.S.C. § 119(a) to German Patent Application No. 20 2019 104 688.0, which was filed in Germany on Aug. 27, 2019, and which is herein incorporated by reference.

BACKGROUND OF THE INVENTION

Field of the Invention

The present invention relates to a contact insert for a conductor terminal for connecting at least one electrical conductor, wherein the contact insert comprises at least one bus bar and at least one clamping spring. The invention also relates to a conductor terminal with such a contact insert.

Description of the Background Art

The invention thus relates to the field of conductor connection technology involving clamping springs. Such conductor terminals are known, for example, from DE 10 2010 051 899 B4, which corresponds with U.S. Pat. No. 8,491,327, which is incorporated herein by reference.

SUMMARY OF THE INVENTION

It is therefore an object of the present invention to further optimize a contact insert and conductor terminal, for example with regard to the size, manufacture and/or assembly.

This object is achieved in an exemplary embodiment by a contact insert for a conductor terminal for connecting at least one electrical conductor, wherein the contact insert comprises at least one bus bar and at least one clamping spring, wherein the bus bar has at least one through opening, wherein the contact insert has a perforated collar which is designed as a component separate from the bus bar, wherein the perforated collar surrounds the through opening at least partially or completely circumferentially on at least one side of the bus bar. In contrast to the prior art, in which such a perforated collar is designed as a material passage of the bus bar and is therefore inevitably formed in one piece with the bus bar, it is hereby proposed to use a separate component for forming the perforated collar. Even if at first glance this appears to increase the complexity of the contact insert or the conductor terminal, many advantages can nonetheless be achieved through such a design.

For example, the formation of several material passages on the bus bar is only possible to a limited extent, wherein in particular a certain minimum distance between the through openings of the bus bar must be present. In the inventive solution in which the perforated collar is formed as a component separate from the bus bar, the material of the bus bar can be left unchanged. Instead, the separate component which forms the perforated collar can be shaped as desired, so that in particular contact inserts can be created on which several closely adjacent through openings are each equipped with a perforated collar on the bus bar. In this way, for example, a compact conductor terminal with a large number of clamping points or through openings arranged close to one another can be provided.

In the manufacturing process, the step of manufacturing the material passage for forming the perforated collar can be omitted. Instead, the separate component that is to form the perforated collar can be used. This can be designed very simply, for example as a plastic component.

The clamping spring, together with the bus bar, can provide a clamping point for the electrical conductor to be clamped in the area of the through opening. This can be implemented, for example, in such a way that a clamping limb of the clamping spring protrudes into the through opening or protrudes through the through opening. The electrical conductor to be clamped can then be clamped between the clamping limb and the edge of the through opening or a tab formed there. The contact insert can be designed as a spring-loaded terminal connection.

The perforated collar surrounding the through opening also provides a conductor chamber in which the electrical conductor to be connected can at least partially be received and guided.

The perforated collar can be formed of a different material than the bus bar. The perforated collar can in particular be formed of a non-metallic material and/or an electrically insulating material, for example plastic. This allows for simple and inexpensive production of the perforated collar with—at the same time—a low weight.

The perforated collar can be fixed relative to the bus bar in various ways, for example in that the perforated collar is attached to the clamping spring or to other parts of the conductor terminal. For example, the perforated collar can be fixed by conductor terminal housing parts.

The separate component forming the perforated collar can be attached to the bus bar. This has the advantage of the bus bar forming a complete structural unit with the perforated collar from which the perforated collar cannot easily be detached again. For example, the bus bar with the perforated collar can be provided as a preassembled unit. In addition, no other fastening measures are required to fix the perforated collar, for example fastening arrangements on a conductor terminal housing.

The separate component forming the perforated collar can be fastened to the bus bar by clamping, latching, gluing or a combination thereof. This allows for both a simple assembly of the elements of the contact insert and a secure permanent connection between the perforated collar and the bus bar.

Thus, the bus bar and/or the perforated collar can have respective fixing elements by means of which the perforated collar can be fixed to the bus bar. If the perforated collar and the bus bar have fixing elements, these can be designed as counterparts that are assigned to one another, for example as latching hooks/latching edges.

The perforated collar can be designed to be circumferential, forming a through hole. The material of the perforated collar thus circumferentially surrounds the through hole, at least in sections or completely.

The through hole of the perforated collar can be aligned with the through opening of the bus bar. In this way, the electrical conductor can be guided through the through opening of the bus bar and the through hole of the perforated collar without hindrance. The perforated collar can form a guide for the electrical conductor.

The perforated collar can be designed as a conductor guide element, which circumferentially at least partially or completely forms a conductor guide for an electrical conductor to be connected to the contact insert.

The perforated collar does not have to align with the through opening of the bus bar on all sides. For example, a long side could be missing and be formed by an edge/shoulder in the housing of the conductor terminal.

The separate component forming the perforated collar can have a conductor stop for the electrical conductor to be clamped and/or an overload stop to limit the maximum deflection of the clamping spring. In this way, the component forming the perforated collar can provide further functions in the conductor chamber, namely the conductor stop and/or the overload stop. Such a conductor stop can mechanically limit the maximum insertion depth of an electrical conductor into the conductor terminal. The overload stop forms a mechanical limitation for the maximum deflection of the clamping spring. Accordingly, no additional features or components are required on the contact insert to form such functions.

At least one area of the perforated collar can protrude into the area of the through opening. This protruding area is well suited to form the overload stop mentioned. For example, the inner peripheral edge of the through hole of the perforated collar below the spring arc of the clamping spring can be shifted into the area of the through opening and can serve as an (overload) stop for the clamping limb.

The bus bar can have several through openings one behind the other and/or several through openings next to one another in the longitudinal direction, several or all of the through openings having a respective perforated collar and, together with a respective clamping spring, providing a respective clamping point for an electrical conductor to be clamped, wherein the perforated collars are designed as a common separate component or as a plurality of components separate from the bus bar. The direction of the largest longitudinal dimension of the bus bar is understood to be the direction of the longitudinal extent of the bus bar. In this way, a particularly small contact insert can be provided with a large number of clamping points, at which several electrical conductors can each be clamped. The individual perforated collars can each be designed as individual, separate components. It is also possible for several or all of the perforated collars to be combined to form a common component, for example a plastic component. Such a component having a plurality of perforated collars can, for example, be designed in the form of a grid with a plurality of through holes arranged like a matrix.

The bus bar in the area of the through opening can have a clamping tab formed from the material of the bus bar and angled relative to the surface of the bus bar, on which the clamping point is formed together with the clamping spring. This allows for particularly reliable clamping of an electrical conductor with a low contact resistance. The clamping spring can, for example, have a clamping edge at the free end of its clamping limb, whereby particularly secure clamping of an electrical conductor at the clamping point can be ensured.

The contact tab can be planar, convex or concave on the surface facing the clamping limb of the clamping spring. A concave design has the advantage that a recess is formed, in which the clamping limb can be mounted with the clamping edge in the rest position, i.e. a defined bearing point is provided for the clamping edge.

The clamping tab can extend at least partially into the space surrounded by the perforated collar. The clamping tab can protrude into the space enclosed by the perforated collar or protrude through it, i.e. exit again on the other side of the perforated collar. In this way, the electrical contacting of the electrical conductor at the clamping point can be further improved.

The object mentioned above is also achieved by a conductor terminal for connecting at least one electrical conductor, wherein the conductor terminal has a housing and a contact insert of the type explained above. According to an advantageous embodiment of the invention, it is provided that the at least one bus bar and the at least one clamping spring are arranged at least predominantly within the housing. The housing can be designed as an insulating housing, for example.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
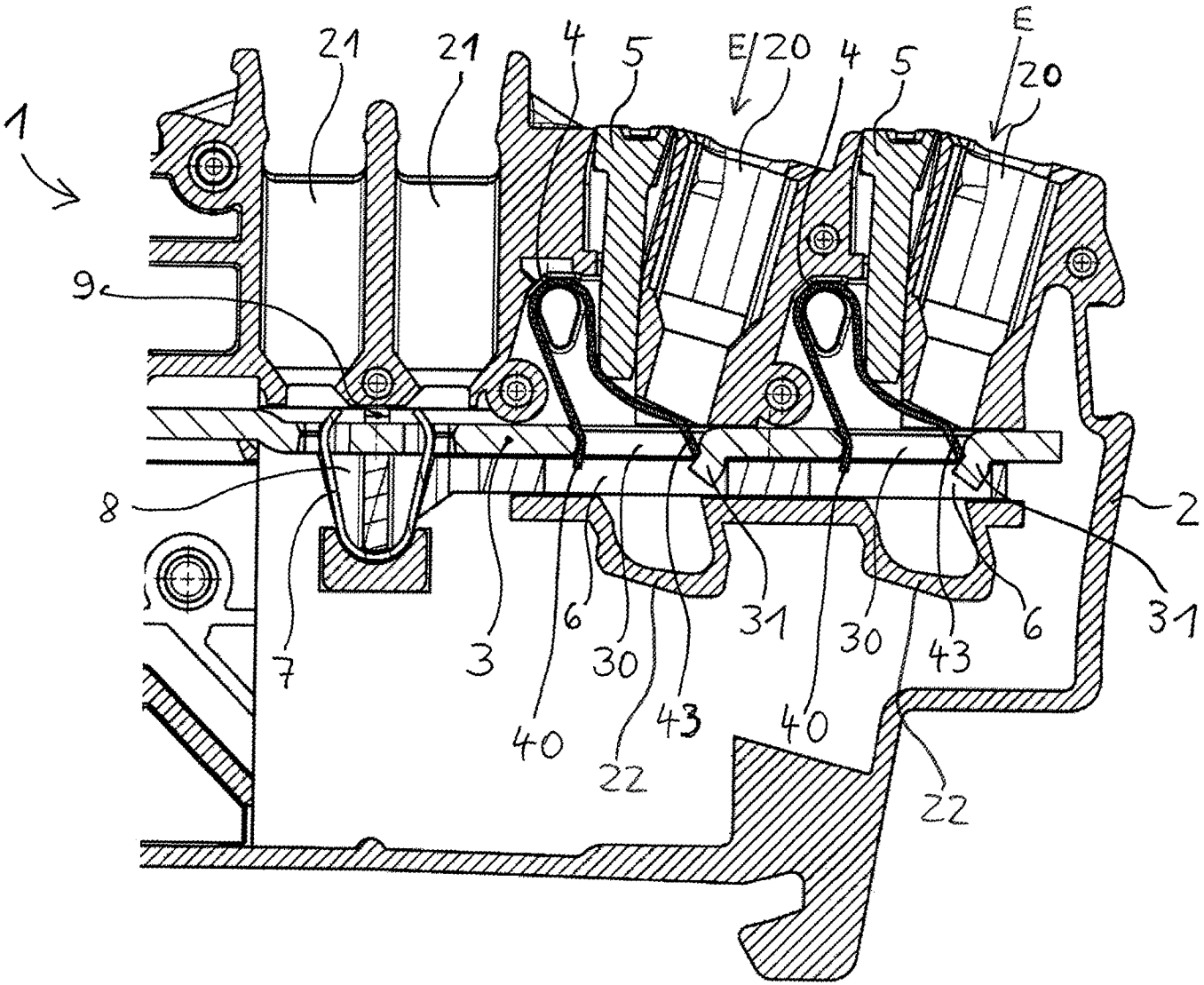
FIG. 1 shows an excerpt of a conductor terminal in a lateral section view.

The conductor terminal 1 that can be seen in FIG. 1 has a housing 2. Conductor insertion channels 20 through which electrical conductors can be inserted into the housing 2 are formed on the housing 2. In addition, jumper slots 21 are formed on the housing 2, through which electrical jumpers can be connected to electrical elements within the housing 2.

In the housing 2, a contact insert of the conductor terminal 1 is arranged, comprising a bus bar 3, clamping springs 4, a perforated collar 6, jumper springs 7 and a jumper spring fixing element 8.

The bus bar 3 is designed as an elongated flat metal part in which one or more through openings 30 are present. A clamping spring 4 is assigned to a respective through opening 30, wherein the respective clamping spring 4, together with the bus bar 3 in the area of the respective through opening 30, provides a clamping point for an electrical conductor to be clamped. In the exemplary embodiment shown, the bus bar 3 has, in each case in the region of a through opening 30, a clamping tab 31 that is formed from the material of the bus bar 3 and angled in the direction of a conductor insertion direction E with respect to the surface of the bus bar 3. The clamping spring 4 rests with a respective clamping limb 43 on the respective clamping tab 31 when no electrical conductor is clamped there. If an electrical conductor is clamped there, this is pressed by the clamping limb 43 against the clamping point in the area of the clamping tab 31. The respective clamping spring 4 is counter-supported via a contact limb 40, i.e. supported against the clamping force of the clamping limb 43. The contact limb 40 can, for example, be suspended in the through opening 30 of the bus bar 3.

To open the respective clamping point, each clamping spring 4 is assigned an actuating element 5, for example in the form of a trigger or actuating lever. By actuating the actuating element 5, the clamping limb 43 can be deflected and moved away from the clamping tab 31 so that an electrical conductor can be inserted there or removed again without any effort.

A respective through opening 30 is surrounded by a perforated collar 6. The perforated collar 6 is designed as a component separate from the bus bar 3.

The jumper springs 7 are held in a desired position relative to the bus bar 3 via the jumper spring fixing element 8. The jumper spring fixing element 8 may have a fixing extension 9 which is inserted through an opening in the bus bar 3 to fix the jumper spring fixing element 8 to the bus bar 3.

Viewed in the conductor insertion direction E, there are conductor receiving pockets 22 behind the bus bar 3 which each serve to receive an electrical conductor clamped to the contact insert. The conductor receiving pockets 22 can be molded as part of the housing 2, for example.

Figure 2:
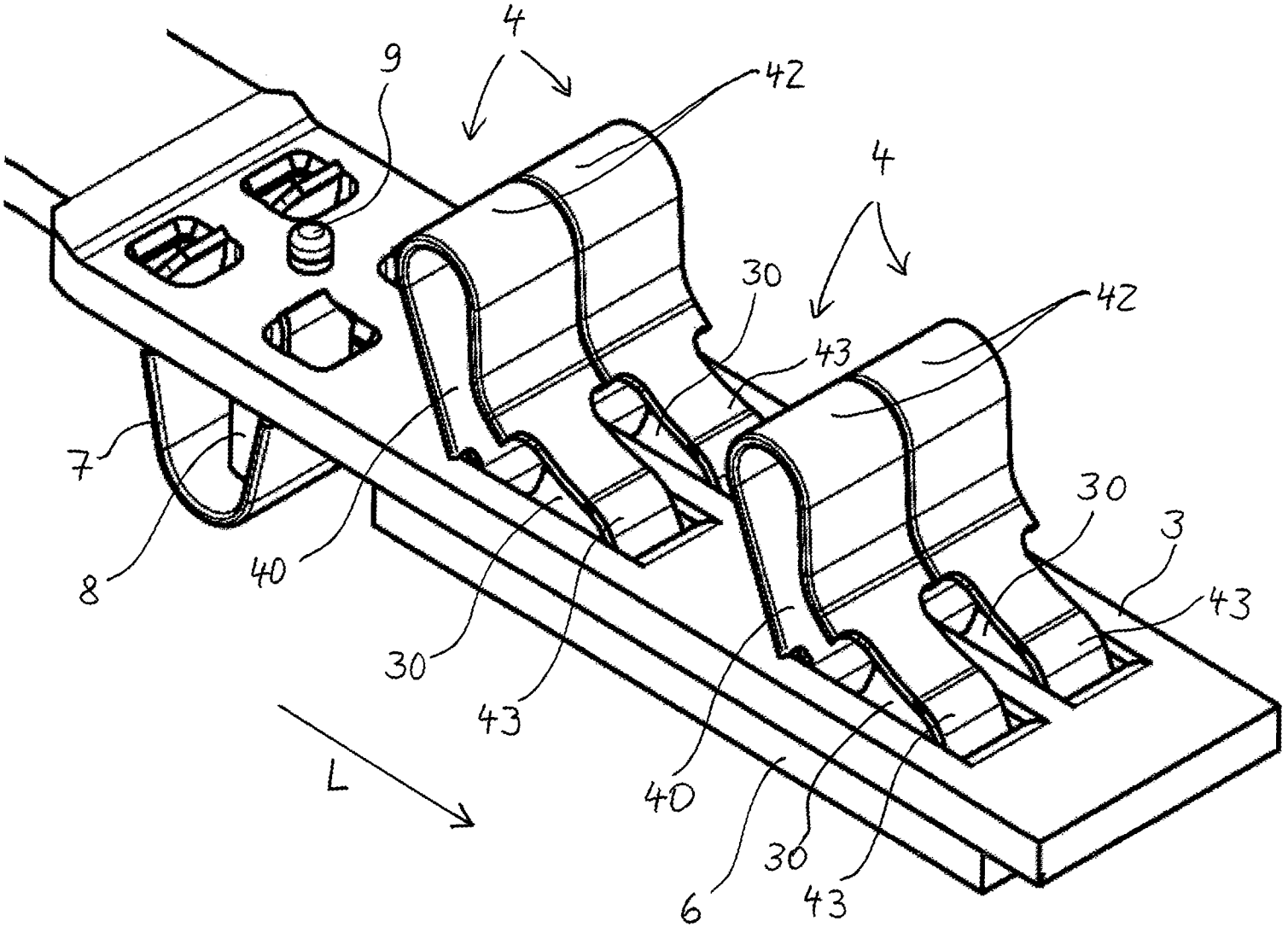
FIG. 2 shows a contact insert of the conductor terminal according to FIG. 1.

FIG. 2 shows the contact insert of the conductor terminal 1 with further details. It can be seen in particular that a respective clamping spring 4 is connected via a spring arc 42 to the respective clamping limb 43, starting from the contact limb 40.

As can also be seen in FIG. 2, a plurality of through openings 30 with respective clamping springs 4 can be arranged one behind the other and/or next to one another in a longitudinal direction L of the bus bar 3. In this way, a large number of spring-loaded terminal connections for connecting electrical conductors can be realized with little space requirement.

Figure 5:
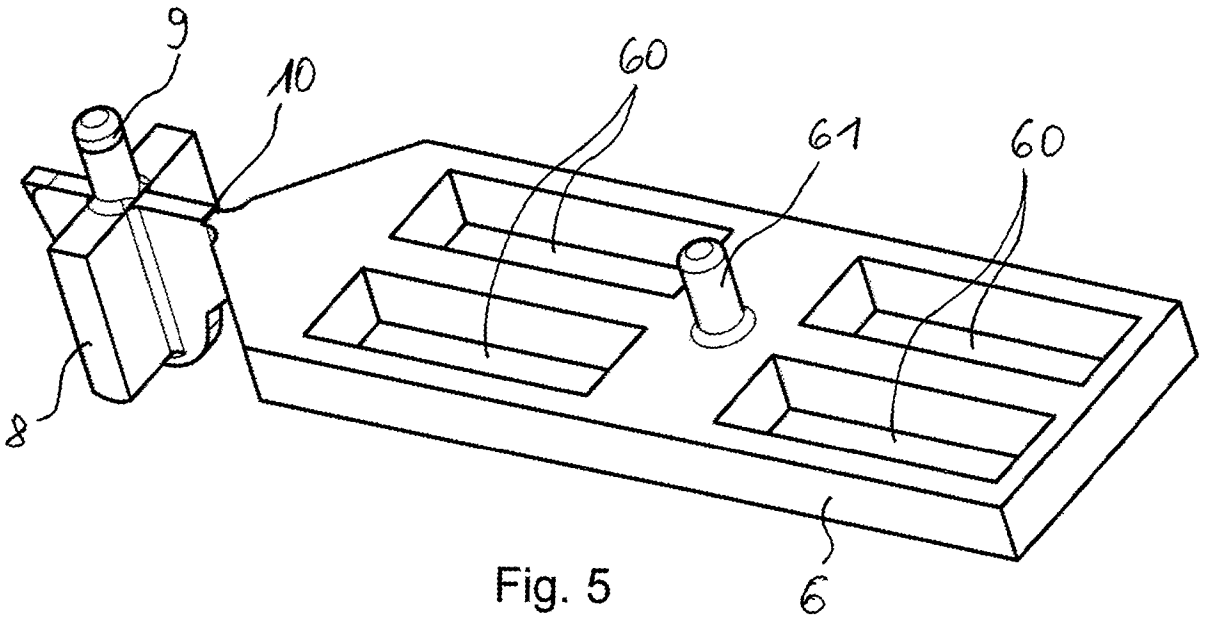
FIG. 5 shows a component forming a perforated collar in an exemplary embodiment.

It can also be seen that the individual perforated collars 6 surrounding the through openings 30 can be combined to form a one-piece, common component, for example a plastic component as shown in FIG. 5 and explained in more detail below.

Figure 3:
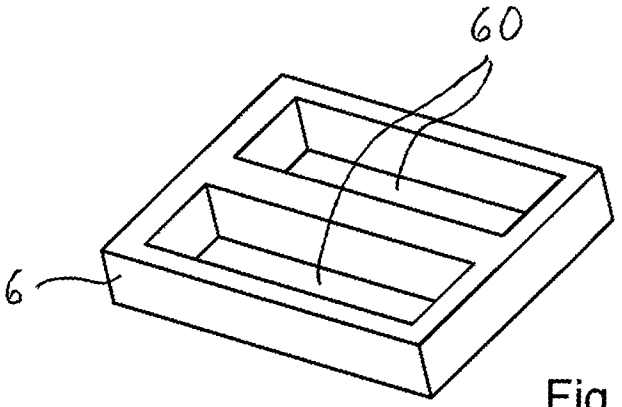
FIG. 3 shows a component forming a perforated collar in an exemplary embodiment.

A perforated collar surrounding a respective through opening 30 can, however, also be designed as a single component or as a combined component that provides perforated collars for several adjacent through openings 30. In this regard, FIG. 3 shows an example in which the component provides the perforated collars 6 for two through openings 30, which are arranged next to one another. Accordingly, the component has two through holes 60 which can be assigned to two through openings 30 of the bus bar 3. In this way, the component thus formed can embody the corresponding perforated collars of two adjacent through openings of the bus bar arranged next to one another. The through openings 30 in the bus bar 3 and the through holes 60 of the perforated collar 6 can be arranged in alignment. In the present exemplary embodiment, the dimensions of the through hole 60 are greater than the dimension of the through opening 30, at least in the longitudinal direction L. This ensures that a free end of the contact limb 40 as well as the clamping tab 31 can dip into the through hole 60. In the example of FIG. 2, for example, two of the components shown in FIG. 3 could be arranged one behind the other in the longitudinal direction L of the bus bar 3.

Figure 4:
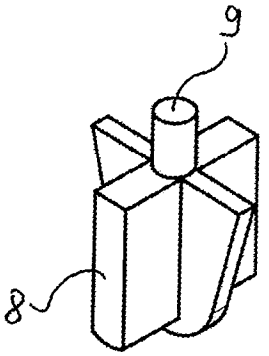
FIG. 4 shows a fixing element for the fixation of jumper connection clamping springs.

By way of example, FIG. 4 shows the jumper spring fixing element 8 with the fixing extension 9 as a separate component.

As shown in FIG. 5, the component forming the perforated collar 6 can also be integrally formed as one component with the jumper spring fixing element 8 in that this is connected via a material bridge 10 to the component forming the perforated collar 6.

FIG. 5 also shows an embodiment in which the perforated collars 6 of all (four) through openings 30 of the bus bar are realized as one component. The component accordingly has four through holes 60.

FIG. 5 also shows a perforated collar fixing element 61 with which the component 6 forming the perforated collar can be attached to the bus bar 3. The perforated collar fixing element 61 can be designed, for example, as a latching projection which can be latched into a latching opening in the bus bar 3.

Figure 6:
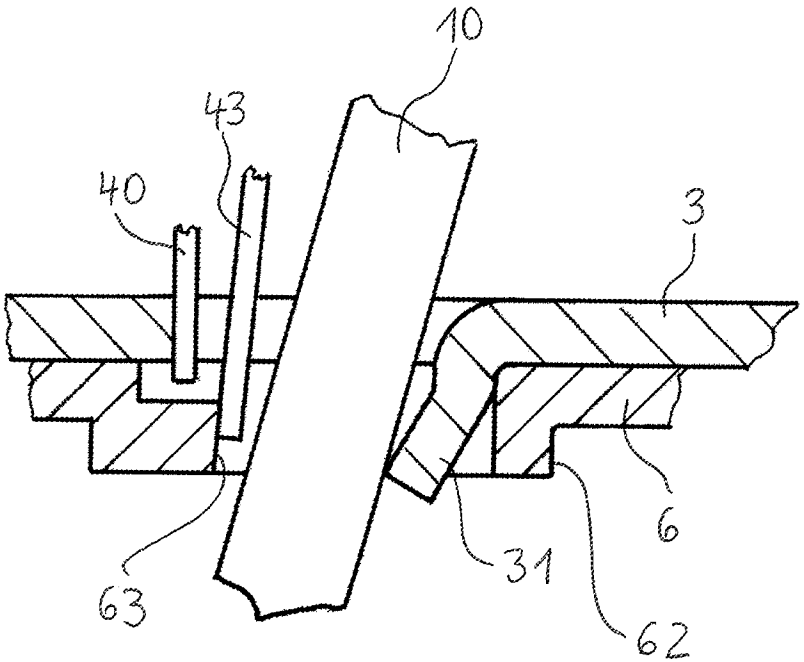
FIG. 6 shows an exemplary embodiment of an excerpt of a contact insert in a lateral section view.

FIG. 6 shows an electrical conductor 10 inserted into the clamping point. The embodiment of the contact insert shown in FIG. 6 has a perforated collar 6, which not only extends as a flat, even part along the bus bar 3, as described above, but also has at least one vertical wall 62 which extends substantially in the vertical direction, away from the bus bar 3. In this way, the advantageous effects of the perforated collar 6, in particular the conductor guide properties for the electrical conductor 10, can be further improved.

As a further additional feature of the perforated collar 6, FIG. 6 shows a spring overload protection, for example in the form of an overload stop 63, which has the effect that the clamping limb 43 of the clamping spring 4 cannot be deflected too far and accordingly cannot be damaged. Thus, the clamping spring 4 cannot be overloaded. The overload stop 63 can be designed, for example, as a lateral contact surface of the perforated collar 6 with which the clamping limb 43 comes to rest at the maximum permissible deflection.

The aforementioned overload stop 63 can, for example, be realized on the vertical wall 62 or also independent of a vertical wall, even if this should be present.

Figure 7:
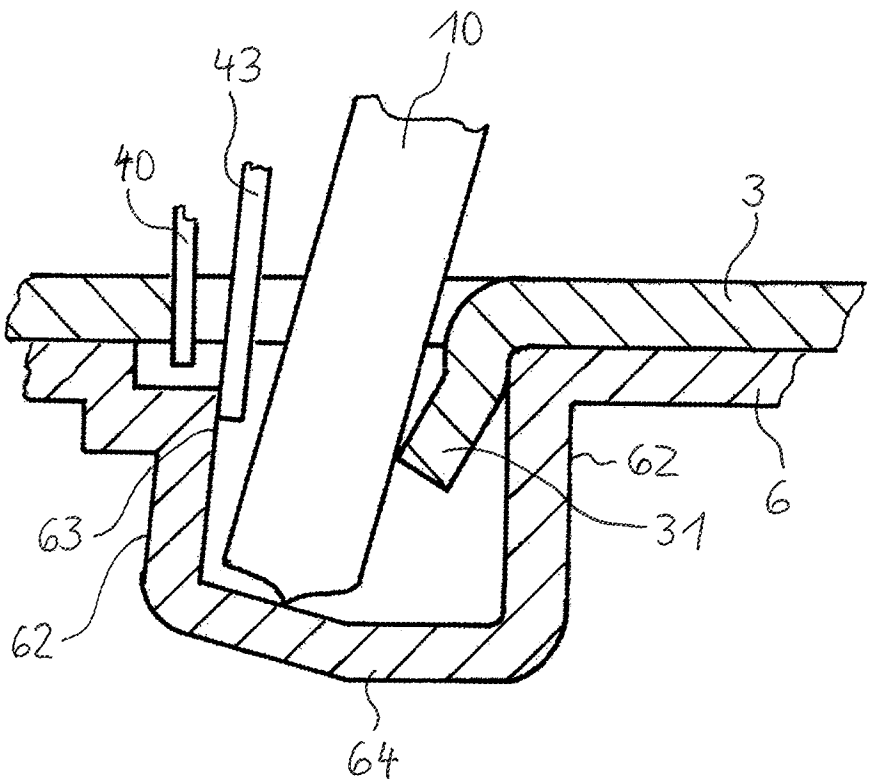
FIG. 7 shows an exemplary embodiment of an excerpt of a contact insert in a lateral section view.

FIG. 7 again shows the overload stop 63 as part of the perforated collar 6, as explained above. In contrast to the embodiment in FIG. 6, the vertical wall 62 is lengthened even further and extends as far as a horizontal wall 64, which extends over to an opposite vertical wall 62 of the perforated collar 6. In this way, the perforated collar 6 can also form a type of conductor receiving pocket for the electrical conductor 10. The conductor receiving pocket can be designed as a completely closed, cup-shaped structure or with interruptions or openings. The horizontal wall 64 also forms a conductor stop for the electrical conductor 10, by means of which the insertion depth of the electrical conductor 10 is limited.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A contact insert of a conductor terminal for connecting at least one electrical conductor, the contact insert comprising:

at least one bus bar having at least one through opening;

at least one clamping spring; and a perforated collar that is a separate component from the bus bar and is arranged on a side of the busbar that faces away from the clamping spring, the perforated collar circumferentially surrounding the through opening at least partially or completely on the side of the bus bar that faces away from the clamping spring.

2. The contact insert according to claim 1, wherein the perforated collar is formed of a different material than the bus bar.

3. The contact insert according to claim 1, wherein the perforated collar rests on the bus bar on the side facing away from the clamping spring.

4. The contact insert according to claim 1, wherein the perforated collar is attached to the bus bar.

5. The contact insert according to claim 4, wherein the perforated collar is attached to the bus bar by clamping, latching, gluing or a combination thereof.

6. The contact insert according to claim 1, wherein the perforated collar is formed circumferentially to form a through hole.

7. The contact insert according to claim 6, wherein the through hole of the perforated collar is aligned with the through opening of the bus bar.

8. The contact insert according to claim 1, wherein the bus bar has several through openings one behind the other and/or several through openings next to one another in a longitudinal direction, and wherein several or all of the through openings comprise a respective perforated collar, the perforated collars being designed as a common separate component or as a plurality of components separate from the bus bar.

9. A conductor terminal for connecting at least one electrical conductor, wherein the conductor terminal comprises:

a housing; and the contact insert according to claim 1.

10. The conductor terminal according to claim 9, wherein a conductor receiving pocket is provided in the housing, wherein the perforated collar is arranged between the bus bar and the conductor receiving pocket.

11. A contact insert of a conductor terminal for connecting at least one electrical conductor, the contact insert comprising:

at least one bus bar having at least one through opening;

at least one clamping spring; and a perforated collar that is a separate component from the bus bar, the perforated collar circumferentially surrounding the through opening at least partially or completely on at least one side of the bus bar, wherein the perforated collar is a conductor guide element that peripherally, at least partially or entirely, forms a conductor guide for an electrical conductor to be connected to the contact insert.

12. The contact insert according to claim 11, wherein the perforated collar has a conductor stop for the electrical conductor to be clamped and/or an overload stop so as to limit a maximum deflection of the clamping spring.

13. The contact insert according to claim 12, wherein at least one area of the perforated collar protrudes into the area of the through opening to form the overload stop.

14. A contact insert of a conductor terminal for connecting at least one electrical conductor, the contact insert comprising:

at least one bus bar having at least one through opening;

at least one clamping spring; and a perforated collar that is a separate component from the bus bar, the perforated collar circumferentially surrounding the through opening at least partially or completely on at least one side of the bus bar, wherein the bus bar has a clamping tab in an area of the through opening that is formed from the material of the bus bar and angled relative to the surface of the bus bar on which, together with the clamping spring, a clamping point for an electrical conductor to be clamped is formed.

15. The contact insert according to claim 14, wherein the clamping tab extends at least partially into the space surrounded by the perforated collar.

* * * * *